US011458471B2

(12) United States Patent
Jones

(10) Patent No.: US 11,458,471 B2
(45) Date of Patent: Oct. 4, 2022

(54) ARRANGEMENT IN A CAPILLARY DRIVEN FLUIDIC SYSTEM AND A DIAGNOSTIC DEVICE COMPRISING THE ARRANGEMENT

(71) Applicant: miDiagnostics NV, Leuven (BE)

(72) Inventor: Benjamin Jones, Leuven (BE)

(73) Assignee: miDiagnostics NV, Leuven (BE)

( * ) Notice: Subject to any disclaimer, the term of this patent is extended or adjusted under 35 U.S.C. 154(b) by 305 days.

(21) Appl. No.: 16/768,754

(22) PCT Filed: Dec. 5, 2018

(86) PCT No.: PCT/EP2018/083628
§ 371 (c)(1),
(2) Date: Jun. 1, 2020

(87) PCT Pub. No.: WO2019/110652
PCT Pub. Date: Jun. 13, 2019

(65) Prior Publication Data

US 2020/0316595 A1 Oct. 8, 2020

(30) Foreign Application Priority Data

Dec. 6, 2017 (EP) ..... 17205644

(51) Int. Cl.
*B01L 3/00* (2006.01)

(52) U.S. Cl.
CPC ..... *B01L 3/502715* (2013.01); *B01L 3/50273* (2013.01); *B01L 2300/0816* (2013.01);
(Continued)

(58) Field of Classification Search
CPC ..... B01L 2200/027; B01L 2200/0689; B01L 2300/0816; B01L 2300/0858;
(Continued)

(56) References Cited

U.S. PATENT DOCUMENTS

2008/0025873 A1* 1/2008 Harding ..... B01L 3/502707 436/178

FOREIGN PATENT DOCUMENTS

WO 01/02093 A2 1/2001
WO WO-0102093 A2 * 1/2001 ..... B01L 3/5023

* cited by examiner

*Primary Examiner* — Jennifer Wecker
*Assistant Examiner* — Jonathan Bortoli
(74) *Attorney, Agent, or Firm* — Hodgson Russ LLP

(57) ABSTRACT

The disclosure relates to an arrangement (100') in a capillary driven fluidic system for preventing wicking of a fluid along an edge (105) between a first substrate (110') and a second substrate (120'), said arrangement comprising: a first substrate (110') including a microfluidic channel (114) arranged to house the fluid, a second substrate (120') arranged to cover a portion of the first substrate (110'), wherein the microfluidic channel (134) of the first substrate (110') meets the second structure (120') at a position (124) along an edge (105) defined between the first (110') and second (120') substrates, wherein the first and the second substrate collectively define a trench (130) for stopping wicking of the fluid along the edge (105), said trench (130) being arranged in at least one of the first substrate (110') and the second substrate (120'), and located at a distance from said position (124) along the edge (105) and intersecting the edge (105).

10 Claims, 9 Drawing Sheets

(52) U.S. Cl.
CPC ..... *B01L 2300/0858* (2013.01); *B01L 2400/0406* (2013.01); *B01L 2400/0688* (2013.01)

(58) Field of Classification Search
CPC ..... B01L 2400/0406; B01L 2400/0688; B01L 3/502707; B01L 3/502715; B01L 3/50273
See application file for complete search history.

ARRANGEMENT IN A CAPILLARY DRIVEN FLUIDIC SYSTEM AND A DIAGNOSTIC DEVICE COMPRISING THE ARRANGEMENT

FIELD OF THE DISCLOSURE

The present disclosure relates to an arrangement in a capillary driven fluidic system. More specifically, the disclosure relates to an arrangement in a capillary driven fluidic system for preventing wicking along an edge of the arrangement. The disclosure further relates to a diagnostic device comprising the arrangement.

BACKGROUND ART

Microfluidics deals with the behavior, precise control and manipulation of fluids that are geometrically constrained to a small, typically sub-millimeter, scale. Technology based on microfluidics are used for example in ink-jet printer heads, DNA chips and within lab-on-a-chip technology. In microfluidic applications, fluids are typically moved, mixed, separated or otherwise processed. In many applications, passive fluid control is used. This may be realized by utilizing the capillary forces that arise within the sub-millimeter tubes. By careful engineering of a so called capillary driven fluidic system, it may be possible to perform control and manipulation of fluids.

Capillary driven fluidic systems may be useful for integrating assay operations such as detection, as well as sample pre-treatment and sample preparation. Sometimes, such operations are carried out using one substrate, or chip. Thus, the substrate must be designed and engineered for a specific purpose. A drawback of such systems is that they cannot be adjusted or extended afterwards. Thus, they cannot in an easy way be combined with other structures comprising other microfluidic systems. The other structure may be a second substrate of the same kind, but may alternatively be another kind of structure, such as for example a supporting cartridge in which the first substrate is inserted. To overcome this limitation, different ways to connect two or more structures have been suggested. One methodology is edge coupling, wherein a first microfluidic channel present in a first structure is connected to a second microfluidic channel present in a second structure at an edge thereof. Hence, the first and second structures will be disposed side by side with each other sharing a common plane. Another methodology is a through hole connection. Here, the microfluidic channel is accessed from the top of the substrate using through holes of a top cover of the substrate.

A problem with connecting two or more capillary-driven substrates or microfluidic devices into a microfluidic system is that, depending on the wetting properties of the fluid/solid surfaces, undesired capillary flows, so called wicking, may occur around the fluidic connections between the two or more microfluidic components of the system. These undesired flows can compromise the functionality of the system.

SUMMARY

Exemplary embodiments provide an arrangement in a capillary driven fluidic system which allows for connecting two or more substrates to each other while preventing the occurrence of wicking at an interface thereof. The arrangement comprises a first substrate including a microfluidic channel arranged to house the fluid and a second substrate arranged to cover a portion of the first substrate. An edge is defined between a portion of the first substrate which is not covered by the second substrate and the portion of the first substrate which is covered by the second substrate. The arrangement allows for fluid present within the microfluidic channel to meet the second substrate without introducing a continuous wicking along the edge which may result in fluid unintentionally leaving the capillary driven fluidic system.

BRIEF DESCRIPTIONS OF THE DRAWINGS

The above, as well as additional objects, features and advantages, will be better understood through the following illustrative and non-limiting detailed description of embodiments described herein, with reference to the appended drawings, where the same reference numerals will be used for similar elements, wherein.

DETAILED DESCRIPTION

Figure 1A:
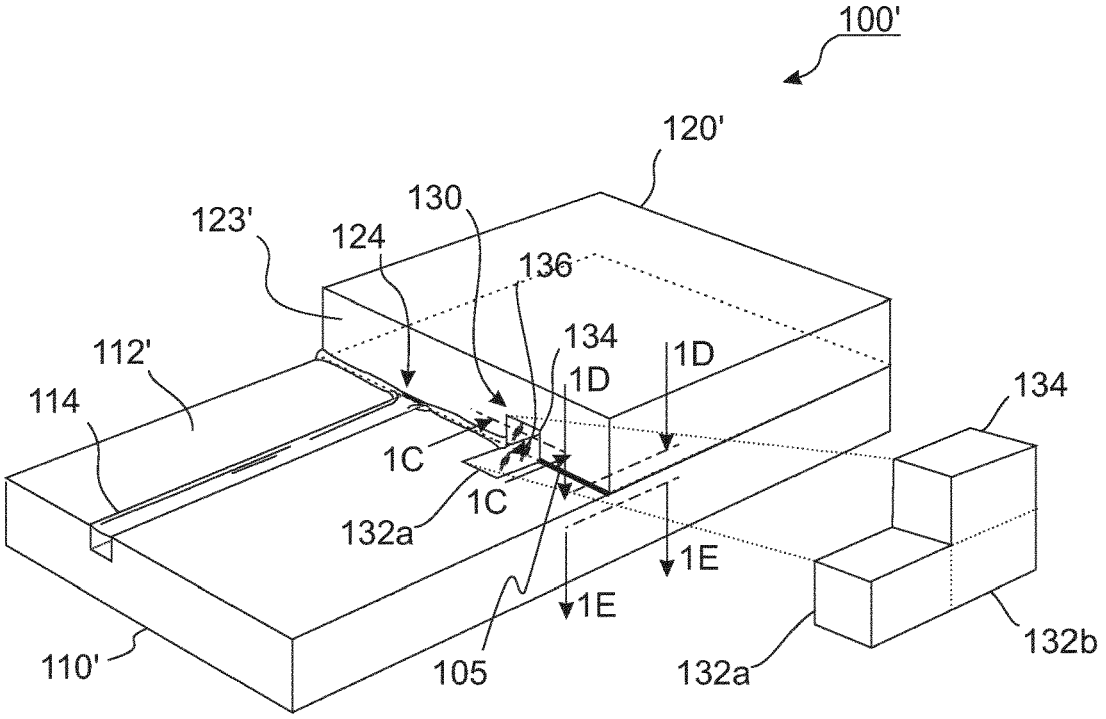
FIG. 1A shows a perspective view of an arrangement in a capillary driven fluidic system according to embodiments of the present disclosure. Further, the geometry of a trench of the arrangement is illustrated separately to the right.
Figure 1C:
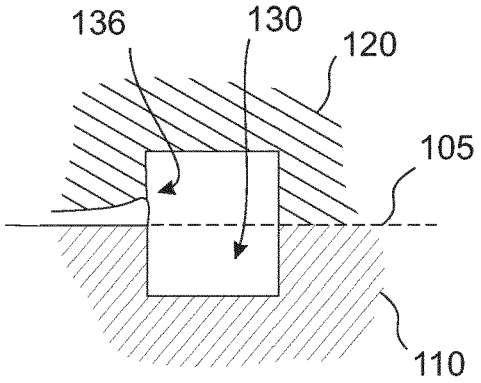
FIG. 1C shows a cross-sectional view of a trench of the arrangement of FIG. 1A, the cross-sectional view being taken along section lines 1C-1C of FIG. 1A.
Figure 1B:
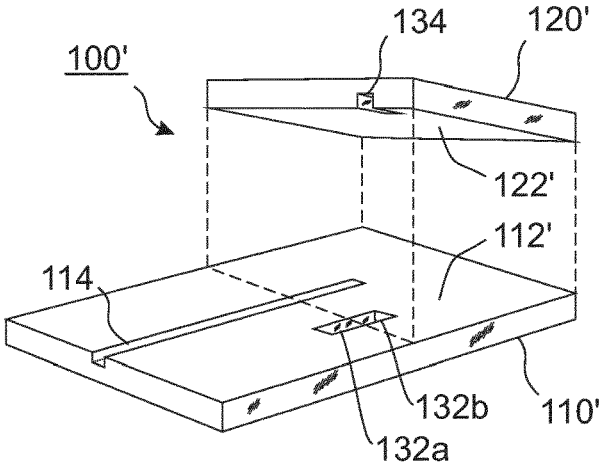
FIG. 1B shows a perspective view of the arrangement of FIG. 1A illustrating the first and second substrates separately.
Figure 1D:
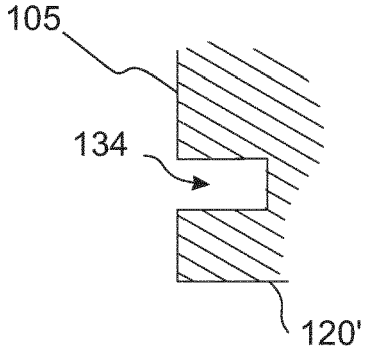
FIG. 1D shows a cross-sectional view of the trench of the arrangement of FIG. 1A, the cross-sectional view being taken along section lines 1D-1D of FIG. 1A, thus showing the portion of the trench defined in the second substrate.
Figure 1E:
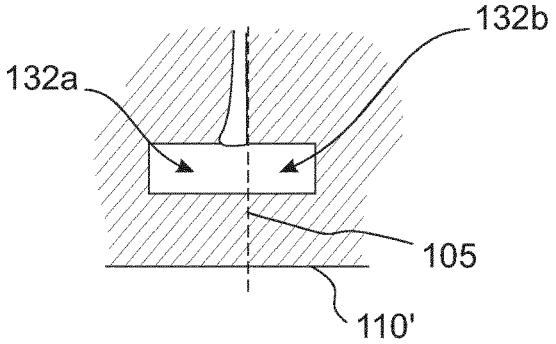
FIG. 1E shows a cross-sectional view of the trench of the arrangement of FIG. 1A, the cross-sectional view being taken along section lines 1E-1E of FIG. 1A, thus showing the portion of the trench defined in the first substrate.

It is an object to mitigate, alleviate or eliminate one or more of the above-identified deficiencies in the art and disadvantages singly or in any combination and solve at least the above mentioned problem.

According to a first aspect there is provided an arrangement in a capillary driven fluidic system for preventing wicking of a fluid along an edge between a first substrate and a second substrate, said arrangement comprising: a first substrate including a microfluidic channel arranged to house the fluid, a second substrate arranged to cover a portion of the first substrate, wherein an edge between the first and the second substrate is defined between a portion of the first substrate which is not covered by the second substrate and the portion of the first substrate which is covered by the second substrate, and wherein the microfluidic channel of the first substrate meets the second structure at a position along the edge, wherein the first substrate and the second substrate collectively define a trench for stopping wicking of the fluid along the edge, said trench being arranged in at least one of the first substrate and the second substrate, and located at a distance from said position along the edge and intersecting the edge.

The proposed solution may be advantageous as it allows to achieve a robust and reliable control over unwanted wicking while, at the same time, the solution is achieved by relatively small structural alterations to the substrate(s), alterations which may readily be created by means of, for example, etching techniques. Should wicking of fluid occur along the edge, the fluid will come to a stop at the position where the edge intersects the trench, whereby the wicking will seize. This will be a result from the sudden expansion of the cross section as function of the direction of motion of the fluid along the edge: As the fluid approaches the trench, the sudden expansion will significantly reduce the capillary pressure at the liquid-vapor interface of the fluid, which results in a loss of driving force on the liquid/vapor interface. Hence, there is little or no risk of fluid entering the trench. Thus, the trench itself will be dry. As the fluid motions is stopped at the trench, no further fluid will leave the microfluidic channel as the capillary pressure at the liquid-vapor interface is not large enough to support further buildup of fluid. Hence, an equilibrium state is reached where a small fraction of the fluid will be present along the edge between the microfluidic channel and the trench, whereby no further wicking will occur.

It is to be understood that the fluid present within the microfluidic channel must be in contact with the edge in order for wicking to occur along the edge. This implies that the microfluidic channel is arranged within the first substrate at a first surface thereof, meets the edge and, at least at the position of meeting the edge, is uncovered. This may be the case for an arrangement where the microfluidic channel is partly covered by the second substrate. Thus, according to some embodiments, the microfluidic channel extends from the portion of the first substrate, which is not covered by the second substrate, to underneath the second substrate. Thus, the microfluidic channel, and hence the fluid it houses, will extend beneath the second substrate which thus may function as a top cover of at least a part of the microfluidic channel. This implies that the inventive concept is applicable also for a situation where the second substrate does not include a microfluidic channel of its own. The first and second substrate may consist of many different materials such as, but not limited to, glass, silicon, plastic, and metals. The substrates may be bonded in a number of different ways including, but not limited to, fusion bonding, adhesive tapes, glue, anodic bonding, thermal compression bonding, and welding. The substrates may advantageously be substantially flat. Thus, the substrates may readily be arranged on top of each other according to the inventive concept. However, parts of a substrate may have a non-flat, or in other ways irregular, shape.

A "trench" is a structure present within the first and/or second substrate, said structure introducing a discontinuity along the edge. This implies that the trench may be a hole, an opening or a recess defined by the substrate material. The trench may be defined in both the first and in the second substrate. In such a case, the trench will, at the position at which the edge intersects the trench, extend over the edge into the second substrate and under the edge into the first substrate. For such a case, the first substrate will comprise a first portion of the trench and the second substrate will comprise a second portion of the trench. In case one of the first and second substrates does not comprise a portion of the trench, the trench will be entirely defined in the other one from the first and second substrate. As will be further detailed later, different embodiments will be possible dependent on the nature of the fluid and/or the surface properties of the first and second substrate.

The "edge" is the line or seam that can be defined to extend along the lower bottom corner of the second substrate. In the ideal case, said line will coincide with the plane that is defined by the first surface of the first substrate. In reality, manufacturing constraints, and potentially any adhesive or other means for bonding the first and second substrates to each other, may result in such a line, as defined hereinabove, being slightly offset from the first surface of the first substrate. In the context of the present disclosure, the term "edge" should therefore be construed using a tolerance. Furthermore, wicking of the fluid along the edge should be construed as a fluid motion that occurs in a general direction of the direction of the edge (i.e., the line or seam). Naturally, parts of a side wall of the second substrate and a first surface of the first substrate will be wetted in the process and the person skilled in the art of capillary flows realizes that said surfaces are necessary for providing the driving force for the wicking to occur along the edge.

According to some embodiments, the trench includes a proximal side wall which connects to said microfluidic channel via the edge. The proximal side wall is hence in fluid communication with the microfluidic channel via the edge. The proximal side wall may extend down into the first substrate and up into the second substrate. The proximal side wall is responsible for stopping the wicking along the edge. As the fluid progresses along the edge and meets the proximal side wall of the trench, the capillary pressure at the liquid-vapor interface suddenly decreases, which forces the fluid motion to seize.

There are many alternative embodiments of the trench and, specifically, the proximal side wall. According to some embodiments, the proximal side wall forms a right angle with respect to at least one from: a first surface of the first substrate, and a first surface of the second substrate wherein the first surface of the first substrate and the first surface of the second substrate is facing one another in the portion of the first substrate which is covered by the second substrate. The right angle may be advantageous from a manufacturing perspective as it is readily achieved by etching techniques. Moreover, the right-angle geometry will provide a reliable operation of the arrangement for a wide variety of fluids and surface materials, such that wicking is effectively stopped by the trench.

According to some embodiments, the proximal side wall is planar. Thus, a portion of the proximal wall defined in the first substrate may be parallel with a portion of the proximal wall defined in the second substrate. Specifically, the trench may define a volume shaped as a right parallelepiped within at least one from the first substrate and the second substrate.

In a case where at least a portion of the trench is defined in the first substrate, said portion will be present in both the portion of the first substrate which is not covered by the second substrate, and in the portion of the first substrate which is covered by the second substrate. This may be important in order to efficiently prevent fluid from continuing its motion when reaching the proximal surface of the trench. In a case where the trench extends also into the second substrate, the trench may be defined by a first subvolume in the portion of the first substrate which is not covered by the second substrate, a second subvolume in the portion of the first substrate which is covered by the second substrate, and a third subvolume in the second substrate; with the first, second and third sub volumes connecting to each other so as to form a single trench volume.

The example embodiments discussed hereinabove are generally right-angled structures defined in the first and/or the second substrate. According to some embodiments, the proximal side wall forms an obtuse angle with respect to at least one from: the first surface of the first substrate, and the first surface of the second substrate. Thus, at least a portion of the proximal side wall may be inclined. For such embodiments, a cross section of the trench may decrease as function of trench depth. The trench may thus be wedge-shaped having tapered walls. An advantage of such a geometry may be to allow easier manufacturing by, for example but not limited to, anisotropic wet etching of silicon. According to some embodiments, the proximal side wall forms an acute angle with respect to at least one from: the first surface of the first substrate and the first surface of the second substrate. The acute angle may be advantageous as it may allow an improved reliability of the trench for stopping the fluid transport, hence preventing wicking.

The trench may be shaped such that the proximal wall forms a specific angle with the edge also in the plane of the first surface of the first substrate. Specifically, according to some embodiments, the proximal side wall forms a right angle with the edge on at least one side thereof, the right angle being defined in the plane of the first surface of the first substrate. According to some embodiments, the proximal side wall forms an oblique angle with the edge on at least one side thereof, the oblique angle being defined in the plane of the first surface of the first substrate. According to some embodiments, the proximal side wall includes a first wall portion and a second wall portion defining a corner at a connection thereof, said corner intersecting with the edge. This implies that the trench may have a V-shape when viewed from above. The V-shaped trench may be an advantage as the oblique angle of the trench with respect to the edge makes it more effective in stopping wicking along the edge.

The trench dimensions may be of importance. The trench may have sufficiently large dimensions so as to effectively and reliably prevent wicking of the fluid at the proximal surface of the trench. The critical dimensions may depend on the surface materials of the first and second substrate, respectively. The critical dimensions may also depend on the properties of the fluid.

Thus, according to some embodiments, the trench has a distal side wall opposed to said proximal side wall, said distal side wall being disposed at least 10 μm from the proximal side wall. According to some embodiments, the proximal side wall extends at least 10 μm from the point of intersection with the edge.

In many situations, there will be a risk of wicking occurring along the edge on both sides of the position where the fluid meets the second substrate. Thus, according to some embodiments, the first substrate and the second substrate further collectively define a further trench being arranged in at least one of the first substrate and the second substrate, wherein said further trench, in relation to said trench, is located on the opposite side of said position at a distance therefrom along the edge, said further trench intersecting the edge. Thus, it is understood that the trench and the further trench are two separate structures arranged on two separate locations both intersecting the edge. The fluid that leaves the microfluidic channel along the edge will thus be trapped in-between the trench and the further trench.

FIG. 1A shows an arrangement 100' in a capillary driven fluidic system. The arrangement 100' is intended for preventing wicking of a fluid along an edge 105 between a first substrate 110' and a second substrate 120'. The arrangement 100' comprises a first substrate 110' including a microfluidic channel 114 arranged to house the fluid, and a second substrate 120' arranged to cover a portion of the first substrate 110'. The substrates 110',120' of the embodiment may consist of different materials such as, but not limited to, glass, silicon, plastic, and metals. The substrates 110',120' may be bonded in a number of different ways including, but not limited to, fusion bonding, adhesive tapes, glue, anodic bonding, thermal compression bonding, and welding. The second substrate 120' is disposed on top of a portion of the first substrate 110' such that another portion of the first substrate 110' is not covered by the second substrate 120'. Thus, the edge 105 is defined between the first 110' and the second 120' substrate between the portion of the first substrate 110' which is not covered by the second substrate 120' and the portion of the first substrate 110' which is covered by the second substrate 120. The edge 105 is thus formed between a side wall 123' of the second substrate 120' and a first surface 112' of the first structure 110'. The second substrate 120' may be manufactured such that the side wall 123' forms a right angle to a first surface 122' of the second substrate 120'. As shown in FIG. 1A, this will, for the example embodiment, provide a 90-degree relationship between the first surface 112' of the first substrate 110' on a first side of the edge 105, and the side wall 123' of the second substrate 120' on a second, opposite, side of the edge 105. Such a geometry may, in some cases, provide a prerequisite for wicking of a fluid along the edge 105. The person skilled in the art of capillary driven fluidic systems readily realizes that the process depends on many other factors, such as the properties of the fluid, the surface properties of the first surface 122' and the side wall 123' and the geometrical dimensions of the system.

The microfluidic channel 114 is defined in the first surface 112' of the first substrate 110'. Thus, the microfluidic channel 114 may be regarded as a recess into said first surface 112'. The dimensions of the microfluidic channel 114 are such that the cross section of the microfluidic channel 114 allows for providing a capillary pressure at a liquid-vapor interface of the fluid high enough for a capillary driven fluidic motion to occur in the microfluidic channel 114. The person skilled in the art of capillary driven fluidic systems realizes that such dimensions may vary dependent on the properties of the fluid and the surface properties of the inner walls of the microfluidic channel 114 etc. The microfluidic channel 114 of the first substrate 110' meets the second substrate 120' at a position 124 along the edge 105. For the example, this occurs because the microfluidic channel 114 is uncovered in the portion of the first substrate 110' which is not covered by the second substrate 120', whereby the fluid housed within the microfluidic channel 114 will have access to, and wet, the edge 105 and parts of neighboring surfaces (side wall 123' and first surface 112'). Furthermore, in the embodiment, the microfluidic channel 114 extends from the portion of the first substrate 110' which is not covered by the second substrate 120', to underneath the second substrate 120'. There are several potential reasons for such a design, some of which will be detailed later.

It is emphasized that some embodiments of the arrangement may comprise a top cover. Specifically, the microfluidic channel 114 may, in the portion of the first substrate 110 which is not covered by the second substrate 120', be partly covered by a top cover. However, such a top cover may not extend all the way to the second substrate 120' to connect with the edge 105.

When the fluid is driven, by capillary forces, to flow within the microfluidic channel 114 in the direction of the edge 105, the liquid-vapor interface of the fluid will eventually make contact with the edge 105. As illustrated in FIG. 1A, this situation may result in wicking of fluid along the edge 105. Thus, fluid will escape from the microfluidic channel 114, potentially affecting the operation of the capillary driven fluidic system of which the microfluidic channel 114 is a part.

To prevent such wicking, the arrangement 100' is equipped with one or more trenches 130, which form parts of the first 110' and/or second 120' substrate. This is illustrated in FIG. 1A, wherein the first substrate 110' and the second substrate 120' collectively define a trench 130 for stopping wicking of the fluid along the edge 105. The trench 130 is arranged in at least one of the first substrate 110' and the second substrate 120', and located at a distance from the position 124 along the edge 105 and intersecting the edge 105. As can be seen in FIG. 1A, for the example embodiment, the trench 130 is arranged in both the first substrate 110' and the second substrate 120'. Referring specifically to the schematic view of the trench volume depicted to the right in FIG. 1A, the trench 130 is defined by a first sub volume 132*a* in the portion of the first substrate 110' which is not covered by the second substrate 120', a second sub volume 132*b* in the portion of the first substrate 110' which is covered by the second substrate 120', and a third sub volume 134 in the second substrate. The first 132*a*, second 132*b*, and third 134 sub volumes connects to each other so as to form a single trench volume.

The trench 130 prevents wicking of the fluid along the edge 105 by effectively stopping the fluid motion. Thus, some fluid will have escaped from the microfluidic channel 114 residing along the edge 105. When the liquid-vapor interface of the fluid reaches the trench 130, the sudden expansion of the cross section will drastically lower the capillary pressure at the liquid-vapor interface, whereby the liquid-vapor interface does no longer experience any driving forces. As this occurs, the fluid motion will stop. One feature of the trench 130 is the vertical trench wall which connects to the edge 105. Said wall is referred to as the proximal side wall 136, since it is the wall of the trench which is closest to the position 124 where the microfluidic channel 114 meets the edge 105. Further, the proximal side wall 136 connects to the microfluidic channel 114 via the edge 105. The proximal side wall 136 may form a right angle with respect to at least one from: a first surface 112' of the first substrate 110', and a first surface 122 of the second substrate 120'. As can be seen in FIG. 1A, the first surface 112 of the first substrate 110' and the first surface 122 of the second substrate 120' is facing one another in the portion of the first substrate 110' which is covered by the second substrate 120'. Thus, for the example embodiment in FIG. 1A-E, the proximal side wall 136 forms a right angle with respect to both the first surface 112' of the first substrate 110', and the first surface 122' of the second substrate 120'. Thus, for the embodiment, the proximal side wall 136 is planar. Moreover, the trench 130 defines volumes shaped as right parallelepipeds within both the first substrate 110' and the second substrate 120'.

Figure 2A:
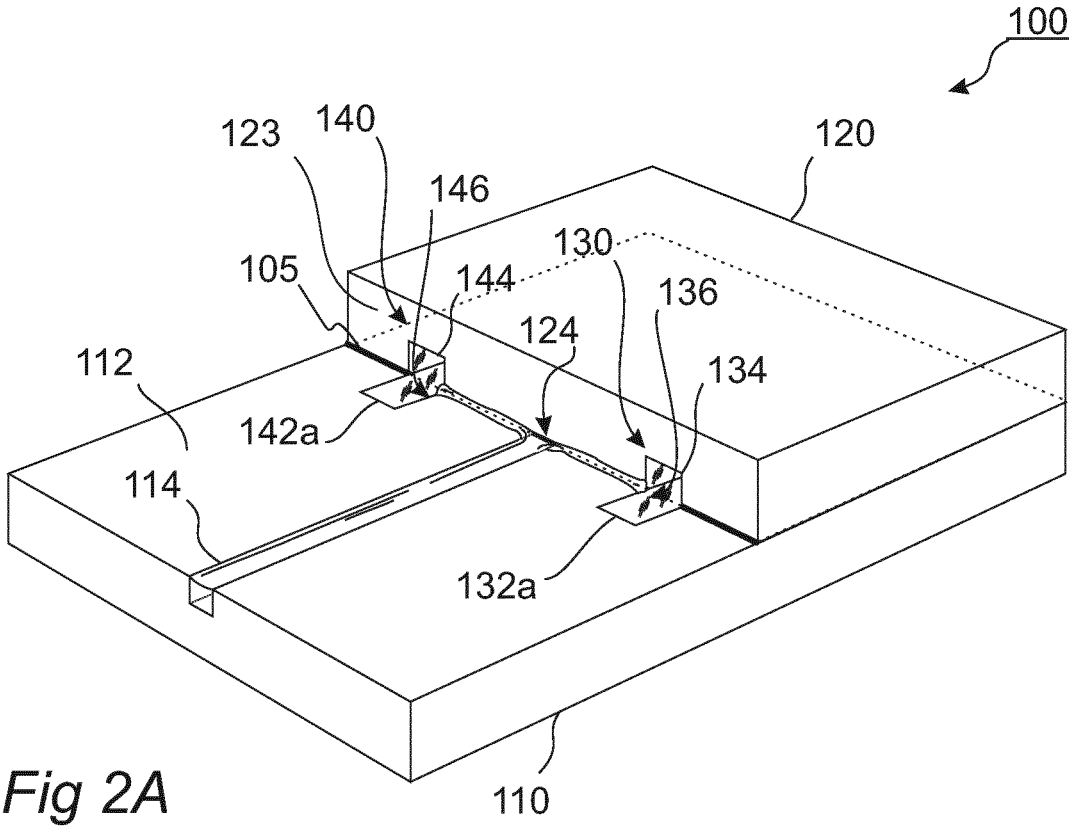
FIG. 2A shows a perspective view of an arrangement in a capillary driven fluidic system according to embodiments of the present disclosure, wherein the arrangement comprises two trenches.
Figure 2B:
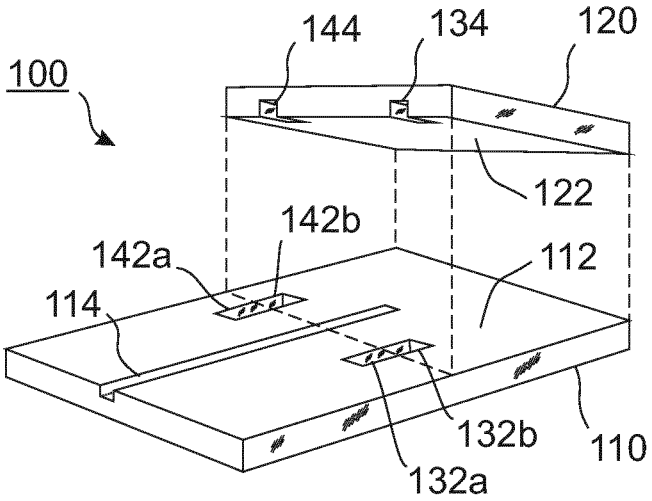
FIG. 2B shows a perspective view of the arrangement of FIG. 2A illustrating the first and second substrates separately.

In many situations, there will be a risk of wicking occurring along the edge on both sides of the position where the fluid meets the second substrate. Thus, there may be a need for more than one trench. FIGS. 2A and B shows an arrangement 100 according to some alternative embodiments. The arrangement 100 is similar to the arrangement 100' of FIG. 1A-E but differs in that the first substrate 110 and the second substrate 120 of the arrangement 100 further collectively define a further trench 140. Similar to the trench 130, the further trench 140 is arranged in at least one of the first substrate 110 and the second substrate 120 (in the example: both in the first 110 and second 120 substrates). In relation to said trench 130, the further trench 140 is located on the opposite side of the position 124 at a distance therefrom along the edge 105. Furthermore, the further trench 140 intersects the edge 105.

Figure 3A:
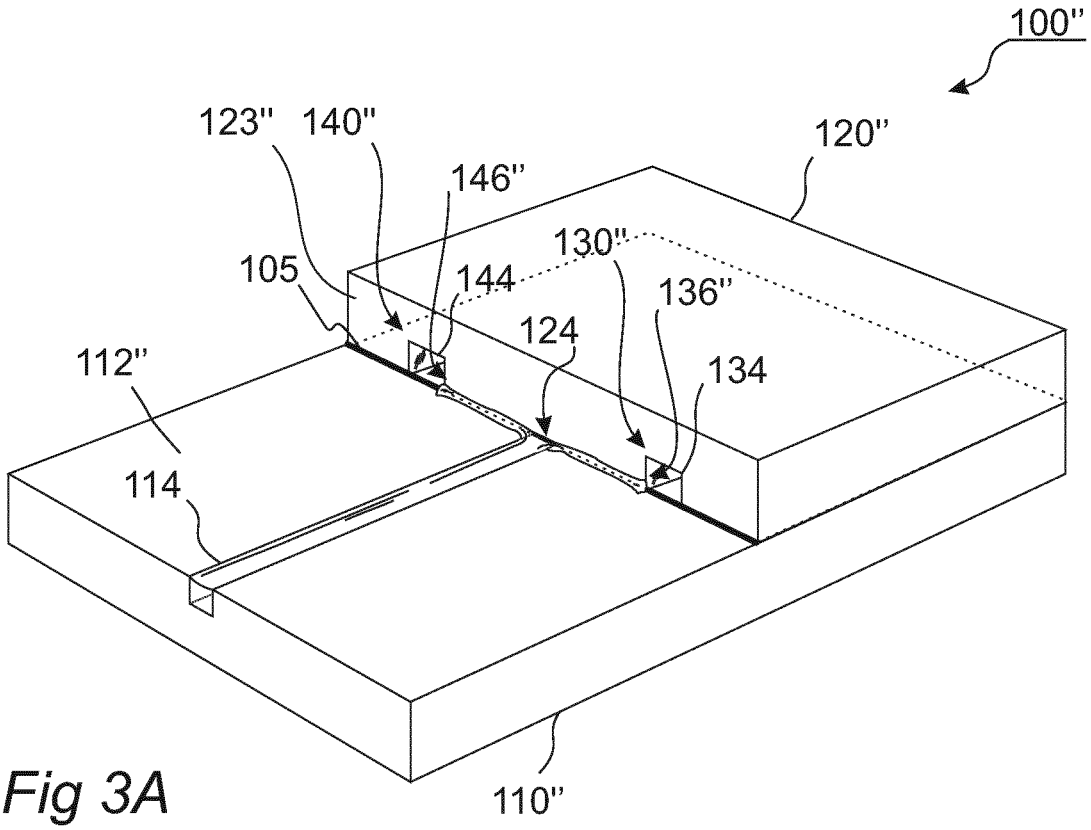
FIG. 3A shows a perspective view of an arrangement in a capillary driven fluidic system according to embodiments of the present disclosure, wherein the arrangement comprises two trenches defined in only the second substrate.
Figure 3B:
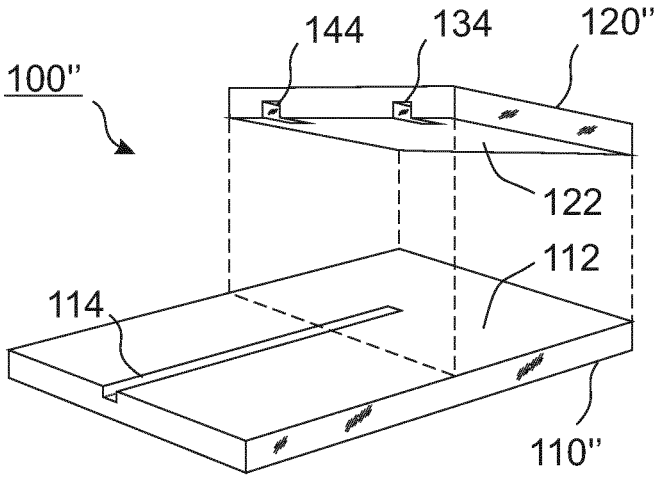
FIG. 3B shows a perspective view of the arrangement of FIG. 3A illustrating the first and second substrates separately.

As previously discussed, the surface properties of the first and second substrates has an influence on the wicking of the fluid. If a surface is repellant to the fluid present within the microfluidic channel, capillary flows may not be easily established. Hence, by tailoring the surface properties, it may be possible to prevent, or at least mitigate, wicking. The inventive concept as defined in the claims thus encompasses embodiments wherein a trench is present only in one of the two substrates. FIGS. 3A and B shows an arrangement 100" according to an example embodiment in which the fluid is a water solution and the side wall 123" of the second substrate 120 is hydrophilic whereas the first surface 112" of the first substrate 110" is either hydrophobic or weakly hydrophilic. As can be seen in FIGS. 3A and B, the trenches 130" and 140" is only defined as a volume within the second substrate 120". The wicking will seize when the liquid-vapor interface reaches the proximal side walls 136",146", whereby the fluid motion will seize as a result from the expansion (trench needed in the second substrate 120" due to its surface being hydrophilic) and as a result from the surface properties being repellant (trench not needed in first substrate 110") as the first surface 112" is hydrophobic. The same principle may be applied for oil solutions where oleophobic or weakly oleophilic surfaces may be used.

Figure 4A:
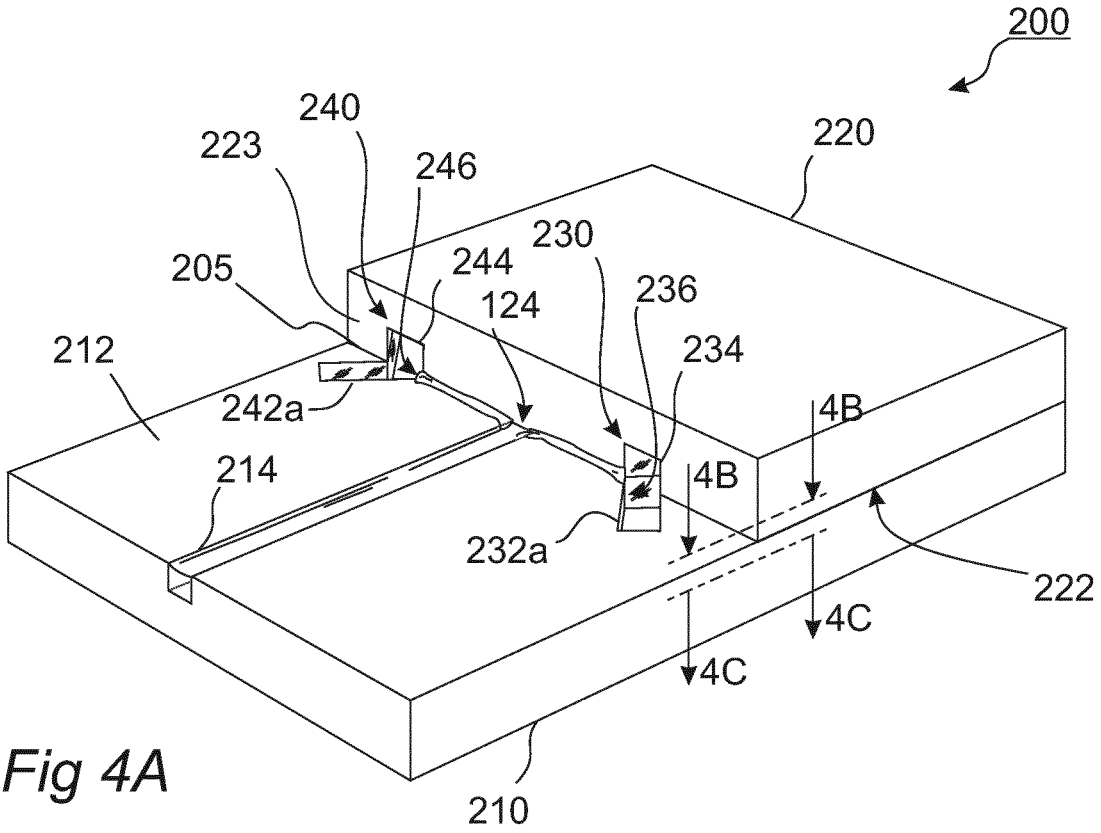
FIG. 4A shows a perspective view of an arrangement in a capillary driven fluidic system according to embodiments of the present disclosure, wherein the trench geometry is V-shaped.
Figure 4B:
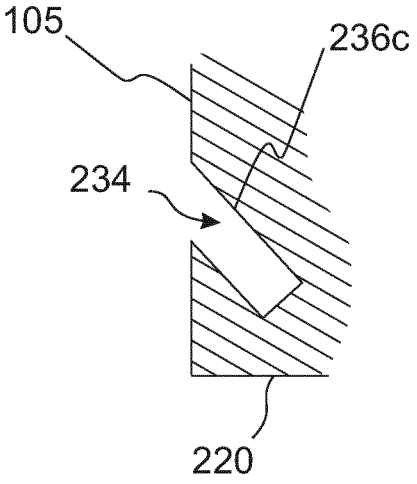
FIG. 4B shows a cross-sectional view of a trench of the arrangement of FIG. 4A, the cross-sectional view being taken along section lines 4B-4B of FIG. 4A, thus showing the portion of the trench defined in the second substrate.
Figure 4C:
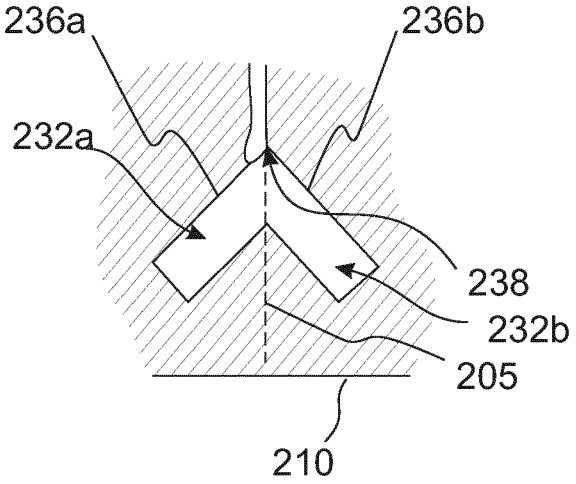
FIG. 4C shows a cross-sectional view of a trench of the arrangement of FIG. 4A, the cross-sectional view being taken along section lines 4C-4C of FIG. 4A, thus showing the portion of the trench defined in the first substrate.

As illustrated in FIGS. 4A-C, which shows an arrangement 200 according to alternative embodiments, the trench geometry may be different. The arrangement 200 is similar to the arrangement 100 apart from the trench geometry. The proximal side wall 236 forms oblique angles with the edge 205 on both sides thereof, the oblique angle being defined in the plane of the first surface 212 of the first substrate 210. Furthermore, the proximal side wall 236 includes a first wall portion 236*a* and a second wall portion 236*b*,236*c* defining a corner 238 at a connection thereof, said corner 238 intersecting with the edge 205. The first wall portion 236*a* forms an obtuse angle with the edge 205, whereas the second wall portion 236*b*,236*c* forms another obtuse angle with the edge 205, said obtuse angles being defined in the plane of the first surface 212 of the first substrate 210. The further trench 240 has the same geometry (but mirrored) as the trench 430. As can be seen in FIGS. 4A and B, the trenches are V-shaped. The obtuse angles may be equal to each other, but may also be different from each other.

Figure 5A:
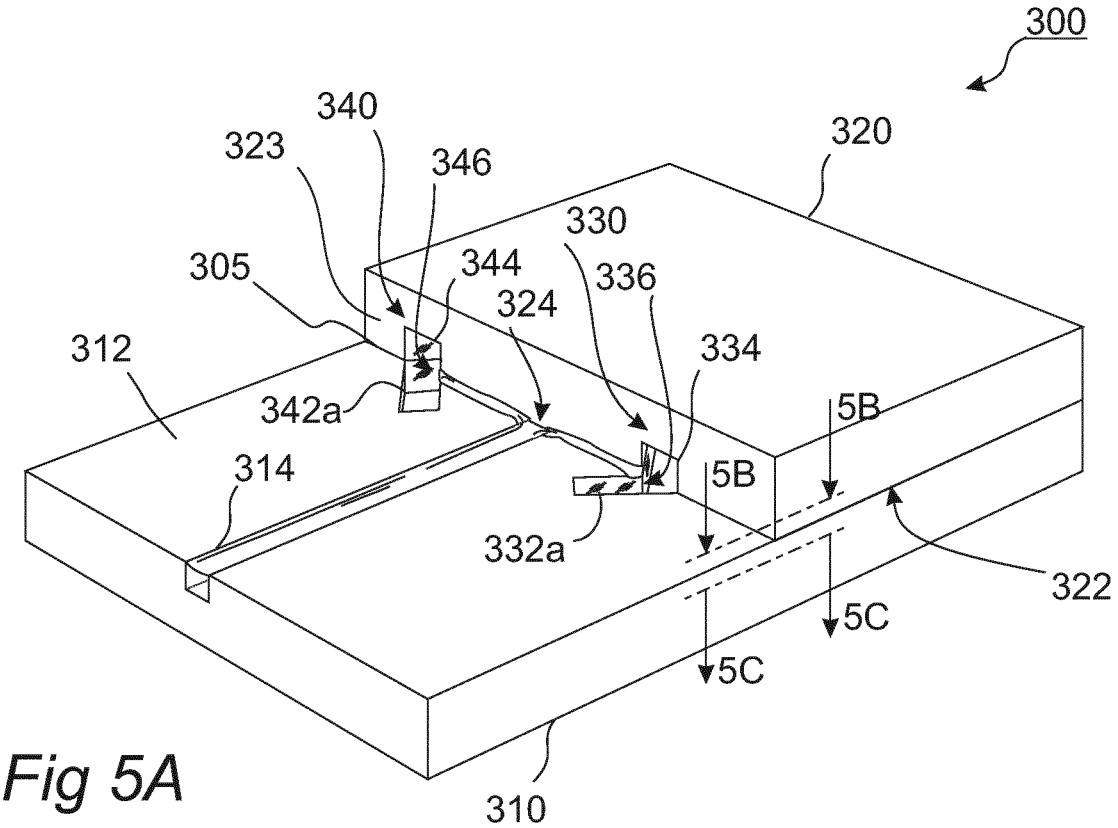
FIG. 5A shows a perspective view of an arrangement in a capillary driven fluidic system according to embodiments of the present disclosure, wherein V-shaped trenches are disposed in an alternative direction as compared to embodiments of FIGS. 4A-C.
Figure 5B:
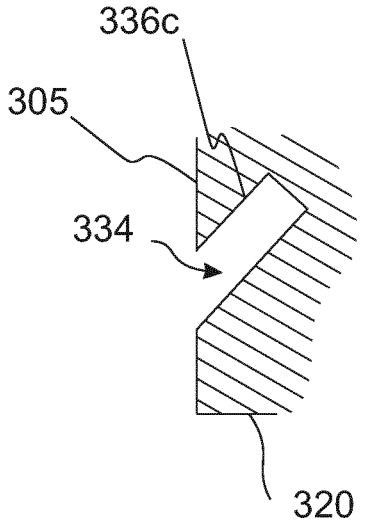
FIG. 5B shows a cross-sectional view of a trench of the arrangement of FIG. 5A, the cross-sectional view being taken along section lines 5B-5B of FIG. 5A, thus showing the portion of the trench defined in the second substrate.
Figure 5C:
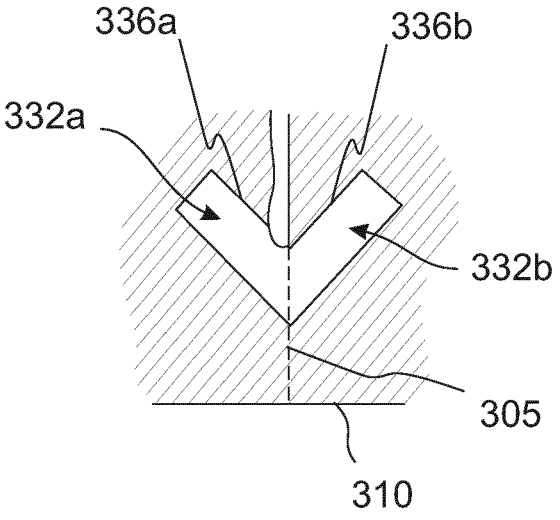
FIG. 5C shows a cross-sectional view of a trench of the arrangement of FIG. 5A, the cross-sectional view being taken along section lines 5C-5C of FIG. 5A, thus showing the portion of the trench defined in the first substrate.

As illustrated in FIGS. 5A-C, which shows an arrangement 300 according to alternative embodiments, the orientation of the V-shaped trenches may be opposed. Thus, the arrangement 300 is similar to the arrangement 200 apart from the trench orientation in relation to the edge 305. Thus, instead of said obtuse angles referred to with reference to FIGS. 4A-C, the first wall portion 336*a* forms an acute angle with the edge 305, whereas the second wall portion 336*b*, 336*c* forms another acute angle with the edge 305, said acute angles being defined in the plane of the first surface 312 of the first substrate 310. The acute angles may be equal to each other, but may also be different from each other.

Figure 6A:
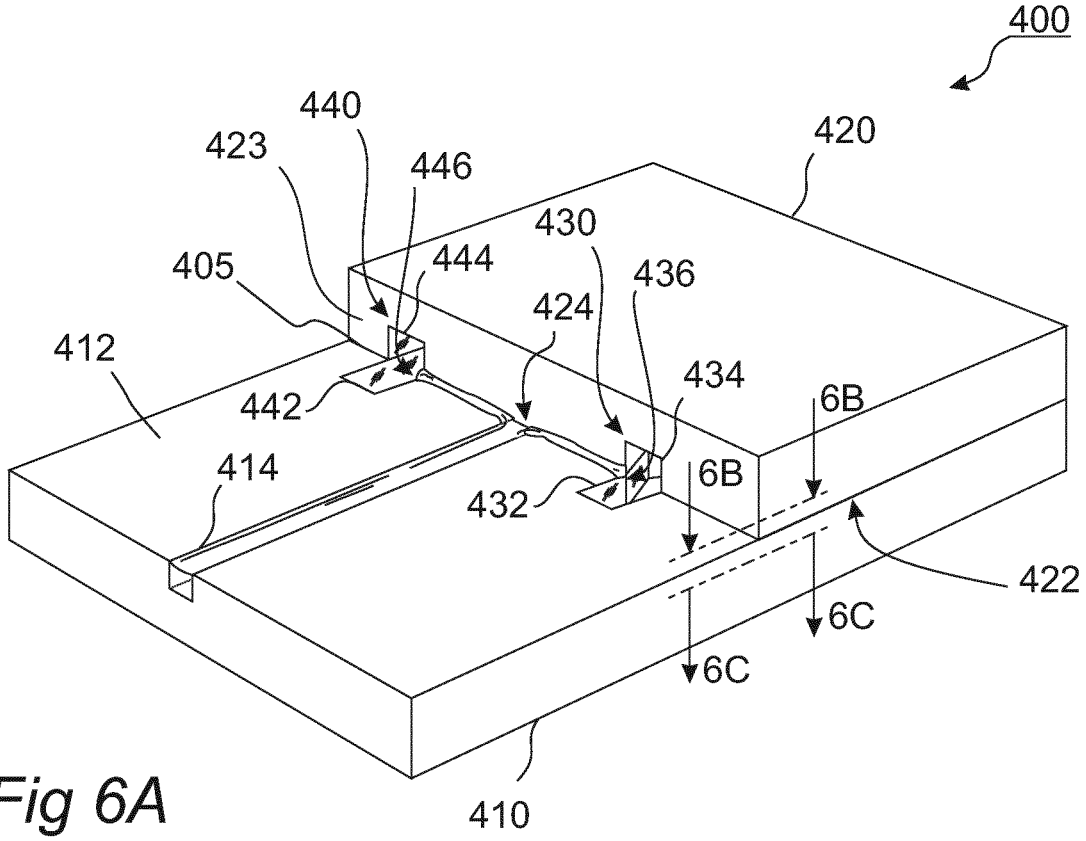
FIG. 6A shows a perspective view of an arrangement in a capillary driven fluidic system according to embodiments of the present disclosure, showing yet another example of a trench geometry.
Figure 6B:
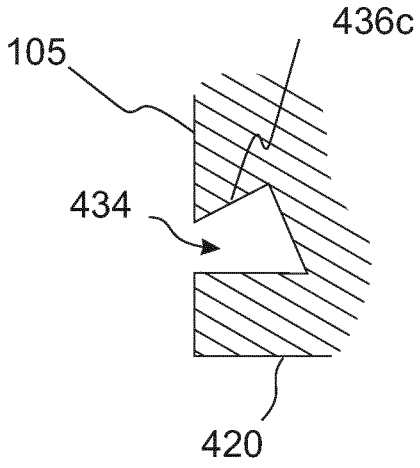
FIG. 6B shows a cross-sectional view of a trench of the arrangement of FIG. 6A, the cross-sectional view being taken along section lines 6B-6B of FIG. 6A, thus showing the portion of the trench defined in the second substrate.
Figure 6C:
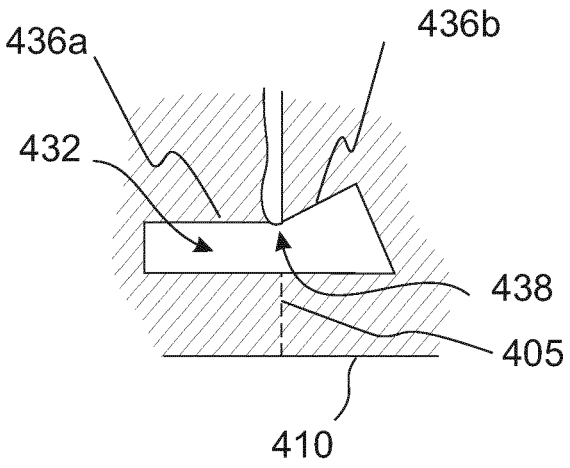
FIG. 6C shows a cross-sectional view of a trench of the arrangement of FIG. 6A, the cross-sectional view being taken along section lines 6C-6C of FIG. 6A, thus showing the portion of the trench defined in the first substrate.

As illustrated in FIGS. 6A-C, which shows an arrangement 400, the trench geometry may have alternative shapes comprising a corner in the proximal wall. The arrangement 400 is similar to the arrangement 100 apart from the trench geometry. The proximal side wall 436 forms an oblique angle with the edge 405 on one side thereof, the oblique angle being defined in the plane of the first surface 412 of the first substrate 410. Furthermore, the proximal side wall 436 includes a first wall portion 436*a* and a second wall portion 436*b*,436*c* defining a corner 438 at a connection thereof, said corner 438 intersecting with the edge 405. The first wall portion 436*a* forms a right angle with the edge 405, whereas the second wall portion 436*b*,436*c* forms an acute angle with the edge 405, said angles being defined in the plane of the first surface 412 of the first substrate 410. The further trench 440 has the same geometry (but mirrored) as the trench 430.

Figure 7A:
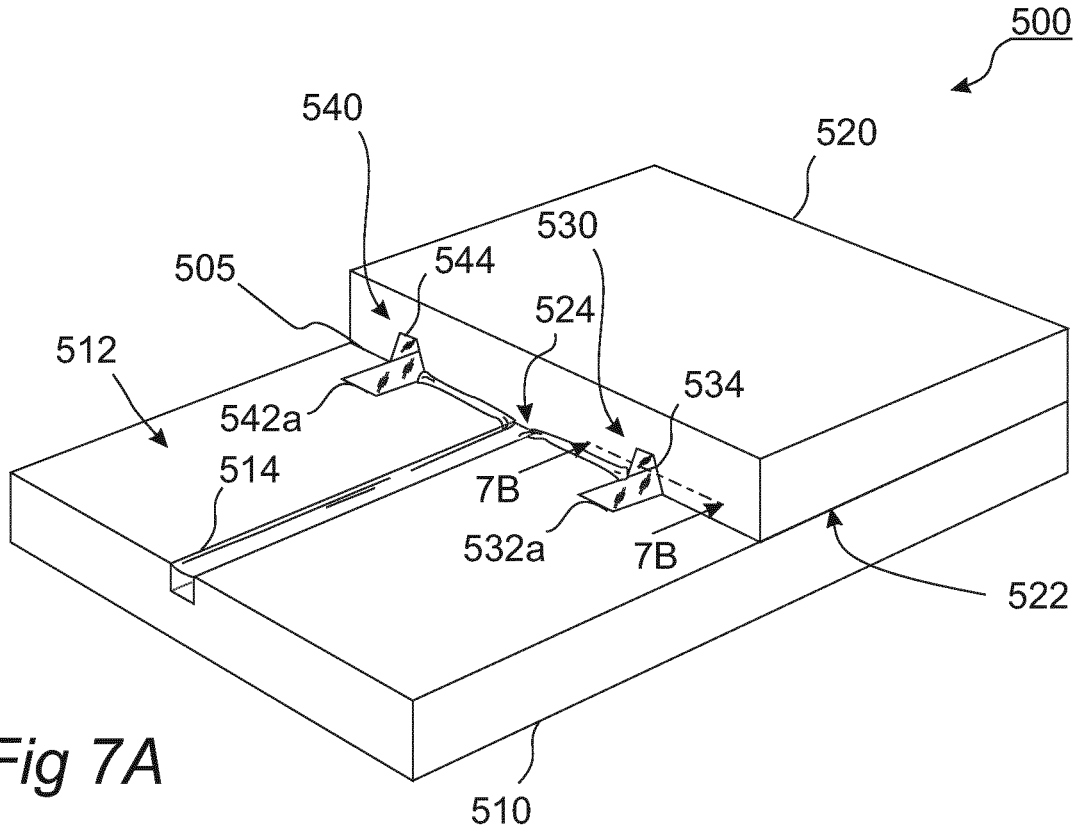
FIG. 7A shows a perspective view of an arrangement in a capillary driven fluidic system according to embodiments of the present disclosure, wherein the trenches have angled proximal side walls.
Figure 7B:
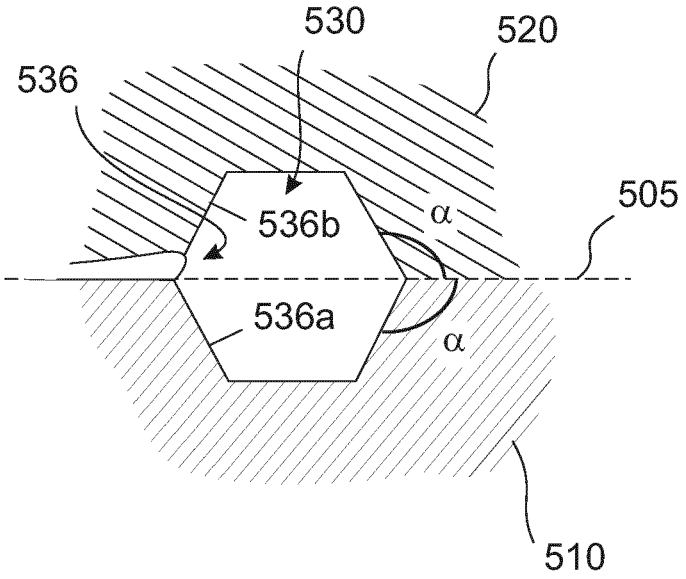
FIG. 7B shows a cross-sectional view of a trench of the arrangement of FIG. 7A, the cross-sectional view being taken along section lines 7B-7B of FIG. 7A.

The proximal side wall may form an angle in relation to the edge also in the vertical plane. Example embodiments of such trench geometries can be seen in FIGS. 7A-B and 8A-B. In FIG. 7A-B, showing the arrangement 500, the proximal side wall 536 forms an obtuse angle $\alpha$ with respect to at least one from: the first surface 512 of the first substrate 510 and the first surface 522 of the second substrate 520. As best illustrated in FIG. 7B, the proximal side wall 536 comprises a first portion 536*a* defined in the first substrate 510 and a second portion 536*b* defined in the second substrate 520. The first portion 536*a* of the proximal side wall 536 forms an angle $\alpha$ with respect to the first surface 512 of the first substrate 510. The second portion 536*b* of the proximal side wall 536 forms an angle $\alpha$ with respect to a first surface 522 of the second substrate 520. The further trench 540 has the same geometry as the trench 530.

Figure 8A:
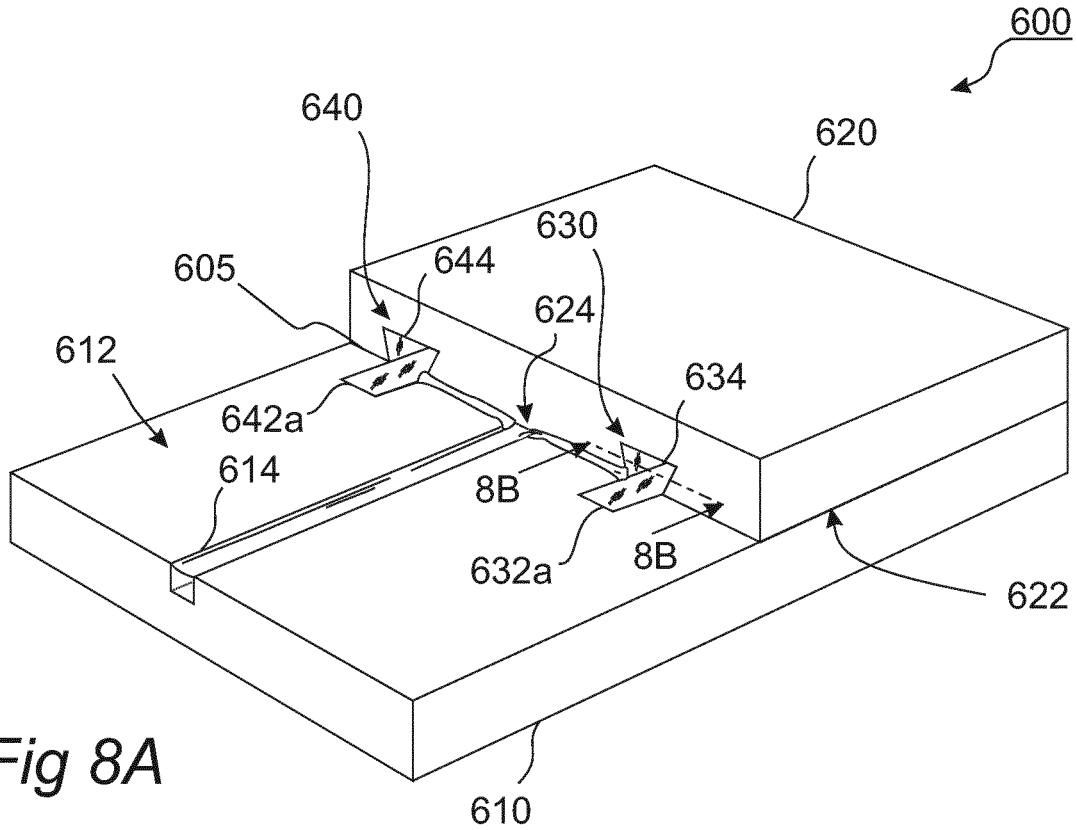
FIG. 8A shows a perspective view of an arrangement in a capillary driven fluidic system according to embodiments of the present disclosure, showing an alternative trench geometry where the trenches have angled proximal side walls.
Figure 8B:
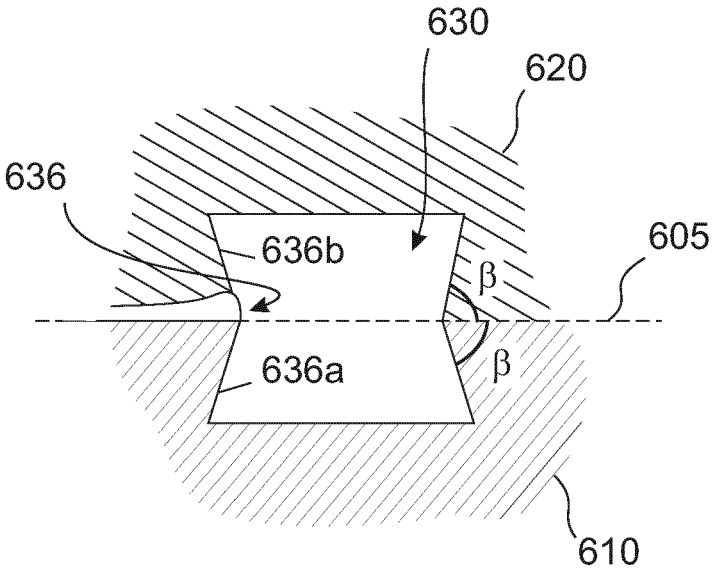
FIG. 8B shows a cross-sectional view of a trench of the arrangement of FIG. 8A, the cross-sectional view being taken along section lines 8B-8B of FIG. 8A.

FIGS. 8A-B shows an opposite situation. Here, for the arrangement 600, the trench 630 has a proximal wall 636 having a first portion 636*a* and a second portion 636*b* forming acute angles 3 with respect to the first surface 622 of the first substrate 620 and the first surface 622 of the second substrate 620, respectively. The further trench 640 has the same geometry as the trench 630.

Figure 9A:
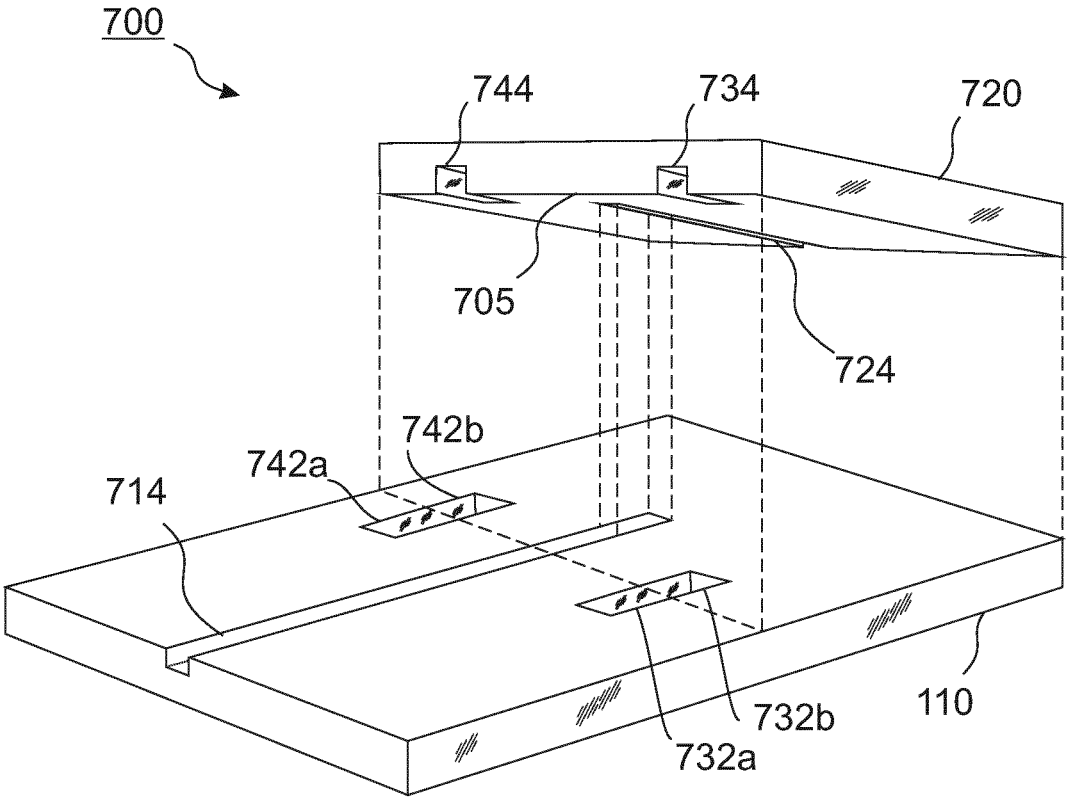
FIG. 9A shows a perspective view of a coupling arrangement in a capillary driven fluidic system according to embodiments of the present disclosure, illustrating the first and second substrates separately.
Figure 9B:
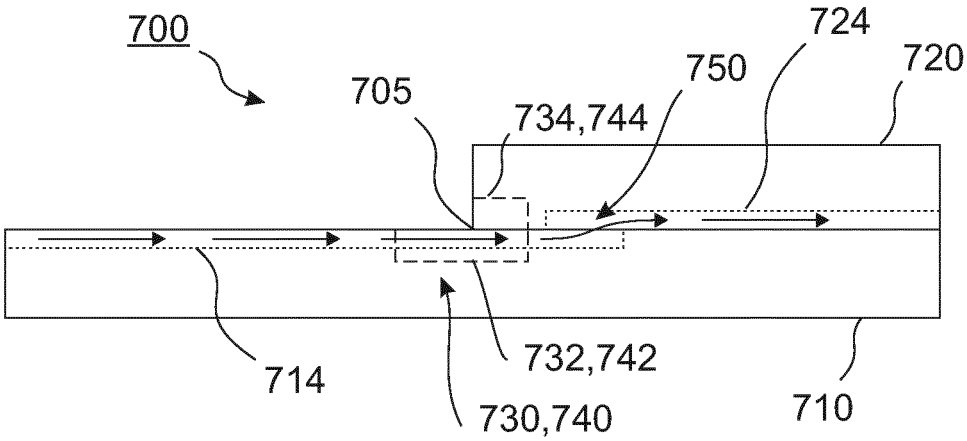
FIG. 9B shows a side view of the coupling arrangement of FIG. 9A.

One useful application for the present inventive concept is coupling two or more substrates together, so as to fluidically connect two or more microfluidic systems (or at least microfluidic channels) with each other. FIG. 9A shows a coupling arrangement according to an example embodiment. The coupling arrangement 700 is intended for coupling a microfluidic channel 714 defined in a first substrate 710 to a further microfluidic channel 724 defined in a second substrate 720. The coupling arrangement 700 comprises an arrangement 100, 100', 100", 200, 300, 400, 500, 600 according to any of the example embodiments disclosed herein (or any other example embodiment within the scope of the appended claims). The coupling arrangement 700 further comprises a further microfluidic channel 724, wherein the further microfluidic channel 724 is included in the second substrate 720 and is in fluid communication with the microfluidic channel 714 of the first substrate 710. A closer comparison between the coupling arrangement 700 and the arrangement 100 reveals that the difference is the further microfluidic channel 724 of the second substrate 720. The operation of the coupling arrangement is further illustrated in FIG. 9B showing the coupling arrangement 700 in a side view (i.e. viewing along the direction of the edge 705). As indicated by the arrows, the fluid present in the microfluidic channel 714 will be driven, by capillary forces, to flow in the direction of the second channel. Wicking will be prevented by the trenches 730,740 being similar to the trenches 730,740 of FIG. 2A. The fluid will then reach an interconnecting region 750 present between the first 710 and second 720 substrates. At the interconnecting region 750, the microfluidic channel 714 will be fluidically connected to the further microfluidic channel 724. For the example embodiment, the two channels 714,724 are in fluid communication with each other. Hence, the fluid may progress from the microfluidic channel 714 over to the further microfluidic channel 724 to continue its motion within the second substrate 720.

The arrangements and coupling arrangements disclosed herein, or any other arrangement and coupling arrangement within the scope of the claims may be used, singly, or two or more of them in combination, in a diagnostic device. Such a diagnostic device may be for example a sample cell for performing optical measurements. The person skilled in the art realized that there are many potential applications for the present inventive concept within microfluidics and the field of lab-on-a-chip diagnostics, and therefore such diagnostic devices are not explicitly disclosed herein.

The person skilled in the art realizes that the inventive concept by no means is limited to the preferred embodiments described above. On the contrary, many modifications and variations are possible within the scope of the appended claims.

For example, the first surface of the first substrate and a side surface of the second substrate connecting to said first surface at the edge may form an angle in relation to each other being less than, or more than, 90 degrees. It is emphasized that the capillary pressure at the liquid-vapor interface will be related to said angle and that tailored side geometry of the second substrate may be performed in combination with the inventive concept. Furthermore, alternative trench geometries may be used. For example, rounded surfaces are conceivable. The trench geometry may be cylindrical, elliptical, spherical etc. Furthermore, for embodiments comprising two trenches, the two trenches may have a different geometry. There may, for example, be increased risk of wicking on one side of the position at which the microfluidic channel meets the edge, making it necessary to design the trench at that side to be more efficient in preventing wicking than the trench at the opposite side of the position.

Additionally, variations to the disclosed embodiments can be understood and effected by the skilled person in practicing the claimed inventive concept, from a study of the drawings, the disclosure, and the appended claims.

The invention claimed is:

1. An arrangement in a capillary driven fluidic system for preventing wicking of a fluid along an edge between a first substrate and a second substrate, said arrangement comprising:

a first substrate including a microfluidic channel arranged to house the fluid, a second substrate arranged to cover a portion of the first substrate, wherein an edge between the first and the second substrate is defined between a portion of the first substrate which is not covered by the second substrate and the portion of the first substrate which is covered by the second substrate, and wherein the microfluidic channel of the first substrate meets the second substrate at a position along the edge, wherein the first substrate and the second substrate collectively define a trench, configured to stop wicking of the fluid along the edge, said trench being arranged in at least one of the first substrate and the second substrate, and located at a distance from said position along the edge and intersecting the edge, wherein the trench includes a proximal side wall which connects to said microfluidic channel via the edge, and wherein the proximal side wall forms a right angle, or an obtuse angle ($\alpha$), or an acute angle ($\beta$), with respect to at least one from: the first surface of the first substrate and the first surface of the second substrate.

2. The arrangement according to claim 1, wherein the microfluidic channel extends from the portion of the first substrate which is not covered by the second substrate, to underneath the second substrate.

3. The arrangement according to claim 1, wherein the proximal side wall is planar.

4. The arrangement according to claim 3, wherein the trench defines a volume shaped as a right parallelepiped within at least one from the first substrate and the second substrate.

5. The arrangement according to claim 1, wherein the proximal side wall forms an oblique angle with the edge on at least one side thereof, the oblique angle being defined in the plane of the first surface of the first substrate.

6. The arrangement according to claim 5, wherein the proximal side wall includes a first wall portion and a second wall portion defining a corner at a connection thereof, said corner intersecting with the edge.

7. The arrangement according to claim 1, wherein the trench is defined by a first sub volume in the portion of the first substrate which is not covered by the second substrate, a second sub volume in the portion of the first substrate which is covered by the second substrate, and a third sub volume in the second substrate; with the first, second and third sub volumes connecting to each other so as to form a single trench volume.

8. The arrangement according to claim 1, wherein the first substrate and the second substrate further collectively define a further trench being arranged in at least one of the first substrate and the second substrate, wherein said further trench, in relation to said trench, is located on the opposite side of said position at a distance therefrom along the edge, said further trench intersecting the edge.

9. A coupling arrangement in a microfluidic system for coupling a microfluidic channel defined in a first substrate to a further microfluidic channel defined in a second substrate, the coupling arrangement comprising:

an arrangement according to claim 1, and a further microfluidic channel, wherein the further microfluidic channel is included in the second substrate and is in fluid communication with the microfluidic channel of the first substrate.

10. A diagnostic device comprising the arrangement according to claim 1.

* * * * *